US010792679B2

(12) United States Patent
Kulkarni et al.

(10) Patent No.: US 10,792,679 B2
(45) Date of Patent: Oct. 6, 2020

(54) COATING SYSTEM AND METHOD

(71) Applicant: General Electric Company, Schenectady, NY (US)

(72) Inventors: Ambarish Kulkarni, Niskayuna, NY (US); Byron Pritchard, Cincinnati, OH (US); Hrishikesh Keshavan, Niskayuna, NY (US); Mehmet Dede, Cincinnati, OH (US); Bernard Patrick Bewlay, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 80 days.

(21) Appl. No.: 15/955,219

(22) Filed: Apr. 17, 2018

(65) Prior Publication Data

US 2019/0314831 A1 Oct. 17, 2019

(51) Int. Cl.
*B05B 1/20* (2006.01)
*B05B 12/00* (2018.01)
(Continued)

(52) U.S. Cl.
CPC ..... *B05B 1/207* (2013.01); *B05B 12/006* (2013.01); *B05B 13/06* (2013.01); *B05B 13/069* (2013.01);
(Continued)

(58) Field of Classification Search
CPC ..... B05B 1/207; B05B 1/046; B05B 12/006; B05B 7/0416; B05B 7/0884;
(Continued)

(56) References Cited

U.S. PATENT DOCUMENTS 2,769,663 A * 11/1956 Jensel et al. ..... B05B 13/0627 239/84
4,211,367 A * 7/1980 Allison ..... B05B 3/02 239/226

(Continued)

FOREIGN PATENT DOCUMENTS

KR 101554883 9/2015
KR 101554883 B1 * 9/2015
WO 2015116300 8/2015

OTHER PUBLICATIONS

Rai et al., CMAS-Resistant Thermal Barrier Coatings (TBC), "International Journal of Applied Ceramic Technology", vol. 7, Issue 5, pp. 662-674, May 11, 2009.

(Continued)

*Primary Examiner* — Dah-Wei D. Yuan
*Assistant Examiner* — Stephen A Kitt
(74) *Attorney, Agent, or Firm* — The Small Patent Law Group LLC; Mary D. Lawlor

(57) ABSTRACT

A coating system includes a support fixture sized to be partially inserted into one or more openings of a component and a spray nozzle segment device comprising a housing configured to receive a slurry. The device is disposed radially outward of a central axis of the component and is shaped to extend circumferentially about at least part of the central axis of the component. The housing comprises plural delivery nozzles configured to spray the slurry onto a surface of the component. The device is operably coupled with the support fixture such that the fixture maintains a position of the device within the component when the support fixture is partially inserted into one or more openings of the component.

21 Claims, 5 Drawing Sheets

(51) Int. Cl.
*B05D 1/12* (2006.01)
*B05B 13/06* (2006.01)
*B05B 15/62* (2018.01)

(52) U.S. Cl.
CPC ..... *B05B 13/0627* (2013.01); *B05B 15/62* (2018.02); *B05D 1/12* (2013.01)

(58) Field of Classification Search
CPC ..... B05B 7/0892; B05B 15/62; B05B 13/0627–0636; B05B 3/044; B05D 1/12
See application file for complete search history.

(56) References Cited

U.S. PATENT DOCUMENTS 5,419,922 A * 5/1995 Bajek ..... B05B 13/005 118/317
5,916,367 A * 6/1999 Wollin ..... B22D 17/2007 118/306
6,010,746 A 1/2000 Descoteaux et al.
7,367,488 B2 5/2008 Payne et al.
7,509,735 B2 3/2009 Philip et al.
7,781,024 B2 8/2010 Krüger et al.
8,356,482 B2 1/2013 Duval et al.
8,470,460 B2 6/2013 Lee
9,395,301 B2 7/2016 Cheverton et al.
9,561,515 B2 2/2017 Richter, Jr. et al.
9,586,369 B2 3/2017 Gersch
2003/0221315 A1 12/2003 Baumann et al.
2009/0169752 A1 7/2009 Fu et al.
2009/0252985 A1 10/2009 Nagaraj et al.
2013/0167375 A1 7/2013 Roesing
2015/0209915 A1 7/2015 Rautenberg
2017/0157719 A1 6/2017 Diwinsky
2017/0173611 A1 6/2017 Tan et al.
2018/0002816 A1 1/2018 Kennedy et al.
2018/0156132 A1* 6/2018 Dede ..... H04N 7/181

OTHER PUBLICATIONS

Wu et al., Evaluation of Plasma Sprayed YSZ thermal Barrier Coatings with the CMAS Deposits Infiltration using Impedance Spectroscopy, "Progress in Natural Science: Materials International", vol. 22, Issue 1, pp. 40-47, Feb. 2012.
Bilge et al., CAMS-Resistant Plasma Sprayed Thermal Barrier Coatings Based on Y2O3-Stabilized ZrO2 with Al3+ and Ti4+ Solute Additions, "Journal of Thermal Spray Technology", vol. 23, Issue 4, pp. 708-715, Apr. 2014.
EP Search Report dated Aug. 22, 2019, 8 pages.

* cited by examiner

COATING SYSTEM AND METHOD

FIELD

The subject matter described herein relates to coatings on machine components.

BACKGROUND

Coatings are extensively used in turbine engines in order to protect various surfaces of the turbine engine when the turbine engine is operating. One example of a coating is a thermal barrier coating. Coatings may often degrade during service of the turbine engine by spallation, damage, or the like. Typically, a thermal barrier coating is restored at regularly scheduled maintenance intervals by disassembling the turbine engine so that a restorative thermal barrier coating can be applied.

This maintenance of the engine results in significant down time and expense. The thermal barrier coating may not wear and degrade in the same manner for each individual aircraft or system that includes an engine with a thermal barrier coating. Thus, a thermal barrier coating may need to be restored at intervals that do not coincide with the regularly scheduled maintenance schedule of the engine or aircraft. The end result is either reduced engine performance resulting from a coating in use that needs to be restored, or unnecessary down time spent restoring a coating that does not need to be restored.

BRIEF DESCRIPTION

In one embodiment, a coating system comprises a support fixture sized to be partially inserted into one or more openings of the component and a spray nozzle segment device comprising a housing configured to receive a slurry. The spray nozzle segment device is configured to be disposed radially outward of a central axis of the component and shaped to extend circumferentially about at least part of the central axis of the component. The housing comprises plural delivery nozzles configured to spray the slurry onto a surface of the component. The spray nozzle segment device is configured to be operably coupled with the support fixture such that the support fixture maintains a position of the spray nozzle segment device within the component when the support fixture is partially inserted into the one or more openings of the component.

In one embodiment, a method comprises maintaining a position of a spray nozzle segment device inside a component with a support fixture. The device comprises a housing configured to receive a slurry. The device is configured to be disposed radially outward of a central axis of the component and shaped to extend circumferentially about at least part of the central axis of the component. The housing comprising plural delivery nozzles configured to spray the slurry onto a surface of the component. The support fixture is sized to be partially inserted into one or more openings of the component. The spray nozzle segment device is configured to be operably coupled with the support fixture such that the support fixture maintains a position of the spray nozzle segment device within the component when the support fixture is partially inserted into the one or more openings of the component. The method also comprises spraying the slurry onto the surface of the component as a coating on the component.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein relate to coating system that effectively improves the life of a barrier coating. The coating system includes one or more spray nozzle segment devices that are disposed inside a component, such as a turbine engine. A support fixture extends between a first end outside of the component and a second end inside the component. The second end of the support fixture is operably coupled with the spray nozzle segment device in order to maintain a position of the device inside the component. The device includes a housing that receives a fluid-and-ceramic slurry mixture, and plural delivery nozzles that spray the mixture onto the component as a coating on the component while the position of the device is maintained.

Two or more devices may be disposed inside the component and operably coupled with each other in order to form a rail system extending circumferentially about at least a part of a central axis of the component. The rail system including plural spray nozzle segment devices spray the mixture as a restorative coating onto plural surfaces substantially simultaneously while the position of each of the devices is maintained by one or more support fixtures. At least one technical effect of the subject matter described herein includes improving the reduction of time to spray or deposit the mixture as the coating onto the component or reducing the time for which the turbine engine is out of service.

The coating system provides a restorative coating onto the component without a locomotion device or locomotion control system to move the spray nozzle segment device over the surfaces of the component to spray the mixture onto the component as the coating. Additionally, the coating system provides a restorative coating onto the component without any moving components inside the turbine engine while the mixture is sprayed onto the interior surfaces of the turbine engine. At least one technical effect of the subject matter described herein includes improved reduction of a risk of lost, faulty, damaged, or the like, of moving components inside the turbine engine.

Figure 1:
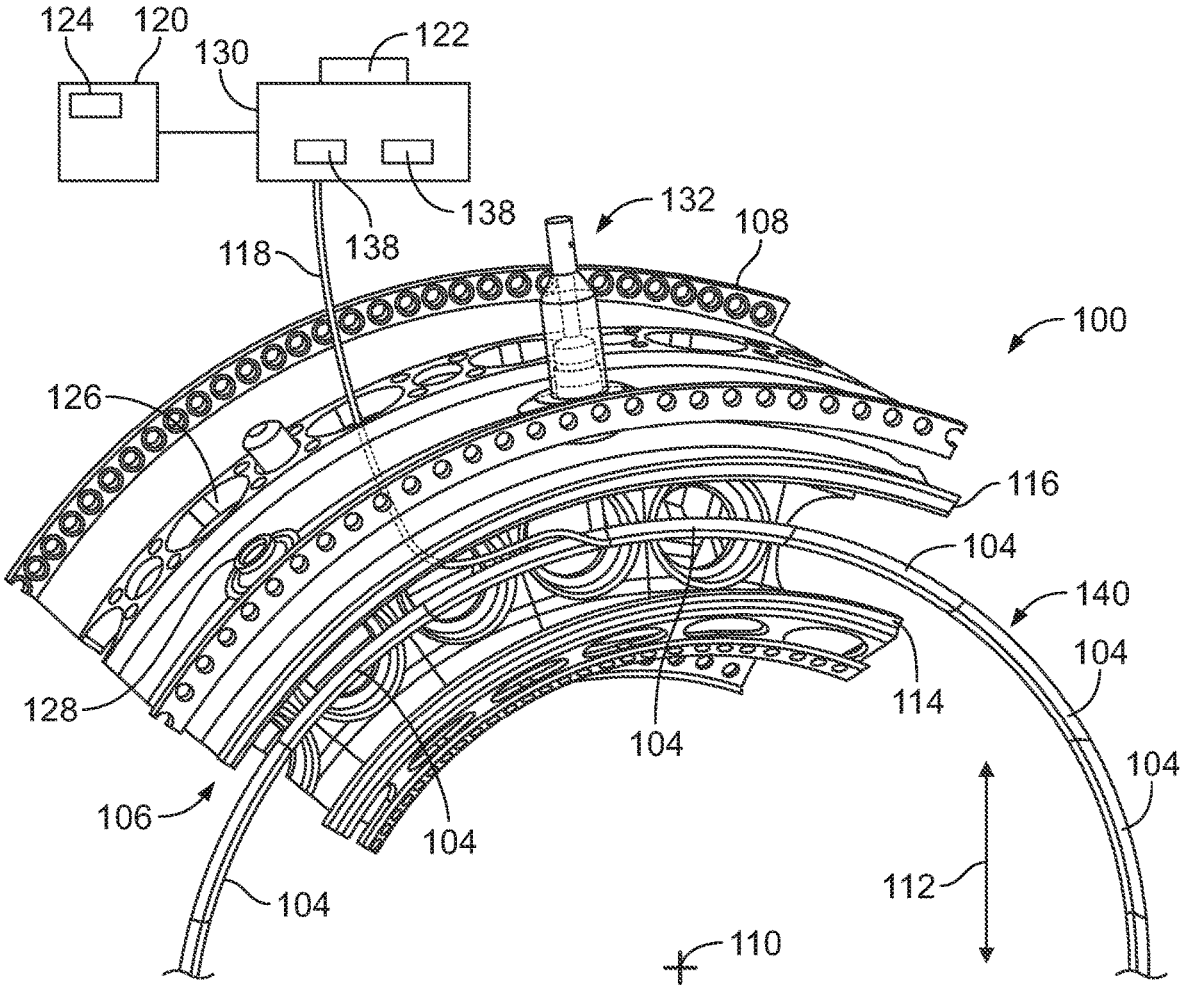
FIG. 1 illustrates a cut-away cross-sectional schematic view of a coating system in accordance with one embodiment.
Figure 2:
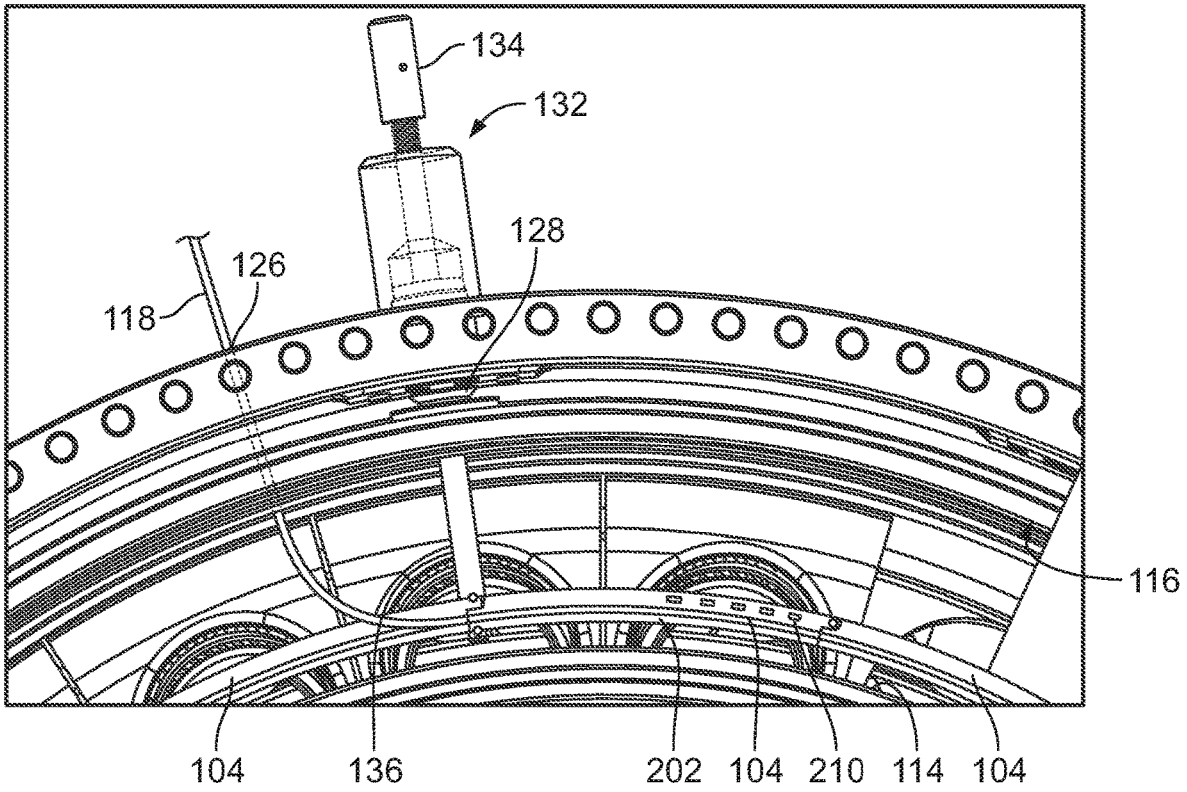
FIG. 2 illustrates a magnified view of the coating system of FIG. 1 in accordance with one embodiment.

FIG. 1 illustrates a cut-away cross-sectional schematic view of a coating system 100 in accordance with one embodiment FIG. 2 illustrates a magnified view of the coating system 100 of FIG. 1. The coating system 100 includes a component 106 that is to be coated on one or more surfaces of the component 106 with a fluid-and-ceramic slurry mixture. The component 106 includes a central axis 110 and an inner surface 114 and an outer surface 116 that extend circumferentially around the central axis 110. The inner and outer surfaces 114, 116 are radially disposed outward of the central axis 110 of the component 106 in a radial direction 112. For example, the inner surface 114 is disposed at a radial position between the central axis 110 and the outer surface 116 in the radial direction 112. In the illustrated embodiment, the inner and outer surfaces 114, 116 are only partially illustrated extending circumferentially around only a part of the central axis 110.

In the illustrated embodiment, the component 106 represents a turbine engine, but optionally may be another type of machine or equipment. The component also includes an outer housing or casing 108 that circumferentially extends around and encloses a rotatable shaft (not shown). The casing 108 includes several ports or openings 126, 128 that extend through the casing 108 and provide access to the interior of the casing 108. These ports or openings 126, 128 may be stage one nozzle ports, stage two nozzle ports, borescope ports, igniter ports, or the like. For example, the openings 126, 128 provide access to the interior of the component 106 without significantly disassembling the component 106 (e.g., the turbine engine).

The coating system 100 also includes one or more spray nozzle segment devices 104 that are disposed radially outward of the central axis 110 between the inner and outer surfaces 114, 116. Each of the devices 104 are shaped such that each device 104 extends circumferentially about at least a part of the center axis 110. For example, each device 104 is shaped such that when the plural devices 104 are operably coupled with each other to form a circular rail system 140, the rail system 140 has a cross-sectional shape that is concentric with and common to the cross-sectional shape of the inner and outer surfaces 114, 116 about the center axis 110. In the illustrated embodiment, each of the plural devices 104 are disposed substantially centered between the inner and outer surfaces 114, 116. Optionally, one or more of the devices 104 may be disposed at a position that is closer to the inner surface 114 than the outer surface 116, closer to the outer surface 116 than the inner surface 114, or at any alternative radial position.

The spray nozzle segment devices 104 are sized in order to be inserted in the component through one or more of the ports or openings 126, 128. For example, the devices 104 may be inserted into the interior of the component 106 without disassembling the component 106 (e.g., the turbine engine). Additionally, the devices 104 are inserted into the turbine engine in order to spray a fluid-and-ceramic slurry mixture onto one or more surfaces of the component 106. For example, the slurry may be sprayed from and deposited onto a thermal barrier coating of one or more surfaces of the component 106.

In the illustrated embodiment, the system 100 includes plural devices 104 that are operably coupled with each other and extend completely circumferentially about the center axis 110. Optionally, the system 100 may include any number of devices 104 that may or may not be operably coupled with each other device 104. Additionally, the coupled devices 104 may not extend completely circumferentially about the center axis 110. For example, the system 100 may include any number of devices 104 that may extend circumferentially about only a part of the central axis 110.

The plural devices 104 may be operably coupled to each other at each end of the devices 104 by a foldable or hinged joint by a fastener, a magnet, or the like. For example, two or more devices 104 may be operably coupled to each other by a hinged joint such that the two devices 104 are coupled together outside the component, are transferred through one of the ports or openings 126, 128, and are unhinged or unfolded such that the two or more devices 104 form a partial substantially circular rail system 140 that extends at least partially about the central axis 110.

Each of the devices 104 includes a housing 202 having a hollow chamber (illustrated in FIG. 4) disposed therethrough. The housing 202 of each device 104 also includes plural delivery nozzles 210. The delivery nozzles 210 operate to direct a coating of the fluid-and-ceramic slurry mixture onto one or more surfaces of the component 106. The housing 202 of the devices 104 will be described in more detail below.

The coating system 100 also includes one or more support fixtures 132. The support fixture 132 is sized to be partially inserted into one or more of the ports or openings 126, 128. The support fixture 132 includes a first end 134 that is disposed outside of the component 106 and a second end 136 that is disposed inside the component 106. For example, the support fixture 132 includes a body that extends between the first end 134 outside of the component 106 and the second end 136 inside the component, wherein the body substantially fills the port or opening 126, 128 in order to be press-fit into the opening 126, 128. Optionally, the body of the support fixture 132 may include any alternative locking mechanism, shape, size, or the like, such that the position of the support fixture 132 is maintained inside the port or opening 126, 128.

The second end 136 of the support fixture 132 is operably coupled with one or more of the devices 104 in order to maintain a position of the devices 104 inside the component 106 between the inner and outer surfaces 114, 116. For example, the second end 136 may be detachably coupled with the device 104 by a fastener, magnet, clamp, or the like. Optionally, the second end 136 may not be detachably coupled with the device 104. In the illustrated embodiment, a single support fixture 132 is operably coupled with the plural spray nozzle segment devices 104 that are operably coupled with each other device 104 to form the rail system 140. Optionally, the system 100 may include any number of support fixtures 132 disposed at any location about the central axis 110 of the component 106.

The support fixture 132 maintains a position of the one or more devices 104 inside the component 106. Additionally, the support fixture 132 maintains a position of the devices 104 while the devices 104 spray the restorative coating on the component 106. For example, the delivery nozzles 210 of each device 104 direct the coating of the fluid-and-ceramic slurry mixture onto one or more surfaces of the component 106 while the position of the device 104 inside of the component 106 is maintained and does not move. The support fixture 132 illustrated in FIGS. 1 and 2 illustrates one embodiment of a support fixture 132. Optionally, the support fixture 132 may have any alternative shape, size, or the like, that allows the support fixture to maintain a position of the spray nozzle segment devices 104 inside the component 106.

The spray nozzle segment device 104 is operably and fluidly coupled with a tube 118. The tube 118 may be a guide tube or a coaxial tube that includes two or more individual tubes disposed inside the tube 118. The tube 118 extends between the device 104 inside the component 106 through one or more of the ports or openings 126, 128 to a reservoir 130 that is disposed outside the component 106. In the illustrated embodiment, the tube 118 fluidly couples a single device 104 with the reservoir 130. Additionally or alternatively, the system 100 may include one or more tubes 118 that may fluidly couple two or more different devices 104 with the reservoir 130. For example, each device 104 may be fluidly coupled with the reservoir 130 by a tube 118. Optionally, the system 100 may include plural tubes 118 that may provide fluid from the reservoir 130 via one or more valves 138.

The spray nozzle segment device 104 receives fluid from the reservoir 130 via one or more pumps (not shown) to provide the fluid-and-ceramic slurry mixture into the device 104. The fluid may be a gas, and the slurry mixture may include water and the ceramic particles such as any solid particles that function to form a coating or that deliver an additive to the component 106. For example, the fluid of the reservoir 130 may be selected to promote evaporation of the fluid in droplets formed by the spray nozzle segment device 104 as the droplets traverse through the air from the device 104 before impacting one or more surfaces of the component 106. In this manner, the fluid is either eliminated from the droplet that impacts the component 106 or the amount of fluid remaining in the droplet impacting the component 106 is substantially reduced. The fluid may be a liquid in one or more embodiments, but alternatively may include a gas.

Similarly, the temperature of the fluid-and-ceramic slurry mixture in the system 100 can be increased, either by a heating element 122, or by a different device or method such that when the fluid is discharged from the spray nozzle segment device 104 again the amount of fluid remaining in the droplet impacting the component 106 is substantially reduced. Such increase in temperature, or heating, can occur at the reservoir 130, in conduits or the tube 118 conveying the slurry to the device 104, or within the spray nozzle segment device 104. In one example, both the temperature of the slurry is increased within the system 100 and the fluid is selected to promote evaporation.

In one or more embodiments, the reservoir 130 may also be designed to reduce the amount of gas from evaporated fluid that is conveyed to the spray nozzle segment device 104 relative to one or more other reservoirs (not shown). Specifically, the reservoir 130 may have an outlet adjacent to the reservoir 130 or can be cooled to prevent gas from evaporated fluid from flowing from the reservoir 130. This ensures that the slurry mixture of fluid and ceramic particles can be created and ensures a minimal amount of fluid evaporates in the system 100 prior to discharging the slurry mixture from the spray nozzle segment device 104.

In one or more embodiments, the system 100 may include a slurry mixture reservoir and a different, separate gas reservoir (not shown). For example, the slurry mixture reservoir may include a slurry of fluid and ceramic materials. The fluid may be alcohol, water, or the like. The gas reservoir may include a different, first fluid that may be a gas such as air, nitrogen, argon, or the like. The first fluid (e.g., air) may be pumped by a pump (not shown), and the slurry may be pumped the same or a unique pump (not shown) into the tube 118 in order to direct the first fluid and the slurry of fluid and ceramic particles into the device 104 to form the slurry inside the device 104. When discharged, the first fluid and the slurry combine to form two-phase droplets. As the droplets traverse toward the surface of the component 106 the liquid in the slurry evaporates leaving only the ceramic particles to provide a uniform coating on the one or more surfaces of the component 106.

In one or more embodiments, the first fluid (e.g., a gas) and the slurry including the ceramic particles mixed with the second fluid liquid (e.g., water) may be mixed inside the reservoir 130 in order to create the fluid-and-ceramic slurry mixture in order to generate the droplets at a location outside of the component. The droplets may be received into the device 104 and then deposited from the device 104 in order to coat the component 106. Additionally or alternatively, the slurry mixture may be mixed inside one or more of the devices 104. For example, the devices 104 may receive the first fluid (e.g., the gas) from the reservoir 130 via a first tube 118, and may receive the second fluid (e.g., the slurry of ceramic particles in the liquid) via a different, second tube 118. The devices 104 may atomize the slurry mixture and generate the droplets inside each device 104.

The system 100 also includes a control system 120. The control system 120 can be used to control operation of the component 106 during spraying of the coating using one or more of the spray nozzle segment devices 104 described herein. The control system 120 includes an equipment controller that represents hardware circuitry that includes and/or is connected with one or more processors (e.g., one or more microprocessors, field programmable gate arrays, integrated circuits, or the like).

The control system 120 also includes a spray controller 124 that controls an amount (e.g., volume) of the slurry that is provided to the device 104, a pressure of the slurry that is provided to the device 104, a flow rate at which the slurry is provided to the device 104, a temporal duration at which the slurry is provided to the device 104, a time at which the slurry is provided to the device 104, or the like. Additionally, each spray nozzle segment device 104 may be fluidly coupled with the reservoir 130 by separate tubes 118. The spray controller 124 may control an amount (e.g., volume) of the slurry that is provided to each of the devices 104, a pressure of the slurry that is provided to each of the devices 104, a flow rate at which the slurry is provided to each of the devices 104, a temporal duration at which the slurry is provided to each of the devices 104, a time at which the slurry is provided to each of the devices 104, or the like. For example, the spray controller 124 may operate autonomously based on a program or software of the control system 120.

Additionally, the spray controller 124 may also control operation of the one or move valves 138 of the reservoir 130 in order to control an amount (e.g., volume) of the slurry that is provided to each of the devices 104, a pressure of the slurry that is provided to the devices 104, a flow rate at which the slurry is provided to the devices 104, a temporal duration at which the slurry is provided to the devices 104, a time at which the slurry is provided to the devices 104, or the like. Additionally or alternatively, the spray controller 124 may control a delivery sequence or delivery schedule of the slurry to each of the spray nozzle segment devices 104 by controlling the valves 138. For example, the spray controller 124 may control a first valve to deliver the slurry to a first device at a first time, and may control the first valve or a different, second valve to deliver the slurry to a different, second device at a second time that is after the first time. Optionally, the spray controller 124 may control operation of the valves 138 in any alternative ways to control the delivery of the slurry from the reservoir 130 to each of the spray nozzle segment devices 104.

In one or more embodiments, the spray controller 124 may also control an amount of the first fluid (e.g., the gas) and/or an amount of the slurry of fluid and ceramic particles that is provided to the reservoir 130 from one or more additional reservoirs (not shown). Additionally, the spray controller 124 may control a pressure of each of the components of the slurry mixture that is provided to the reservoir 130 and/or to the devices 104, a flow rate at which of each of the components is provided to the reservoir 130 and/or to the devices 104, a temporal duration at which each of the components is provided to the reservoir 130 and/or the devices, a time at which each of the components of the slurry mixture is provided to the reservoir 130 and/or the devices 104, or the like. Optionally, the spray controller 124 may also control an amount of the first fluid that is provided to one or more of the devices 104 and an amount of the slurry of fluid and ceramic particles that are provided to one or more of the devices 104. For example, the first fluid and the slurry may be mixed inside the devices 104 in order to atomize the slurry mixture and generate the droplets inside the devices 104.

In one or more embodiments, the system 100 may include plural spray controllers 124. Each of the spray controllers 124 may be operably coupled with one or more reservoirs in order to control the slurry that is provided to a single device 104. For example, each spray controller 124 may control the delivery of the slurry to one or more devices 104. The spray controllers 124 may control an amount (e.g., volume) of the slurry that is provided to each device 104, a pressure of the slurry that is provided to each device 104, a flow rate at which the slurry is provided to each device 104, a temporal duration at which the slurry is provided to each device 104, a time at which the slurry is provided to the device 104, or the like.

The spray controller 124 represents hardware circuitry that includes and/or is connected with one or more processors, and one or more pumps, valves, or the like, of the system 100, for controlling the flow of materials to the device 104 for spraying a restorative coating onto the interior of the component 106. The spray controller 124 can generate signals communicated to the valves 138, pumps, or the like, via one or more wired and/or wireless connections to control delivery of the slurry to the devices 104.

Figure 3:
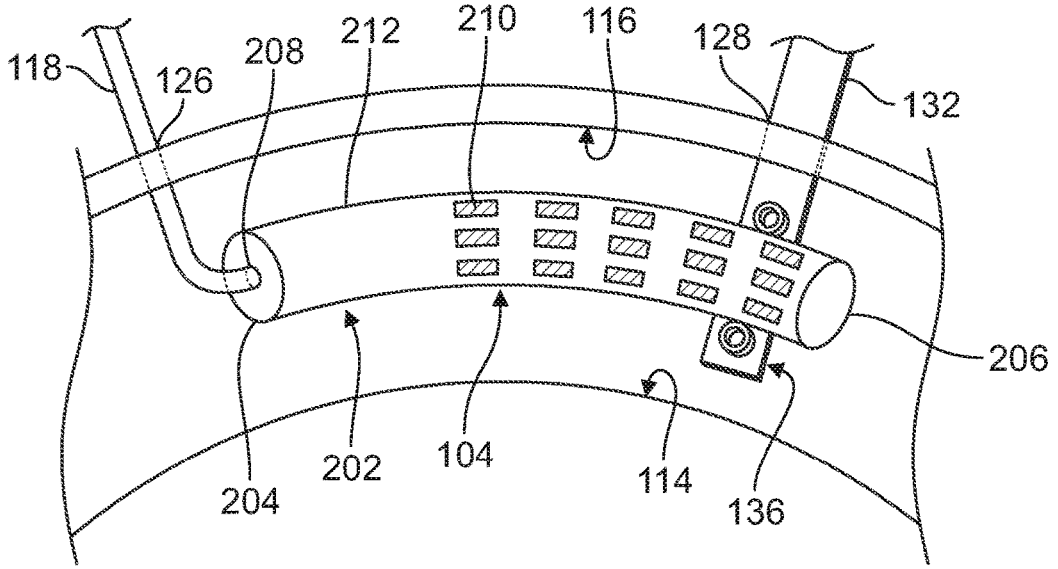
FIG. 3 illustrates a schematic view of a spray nozzle segment device in accordance with one embodiment.
Figure 4:
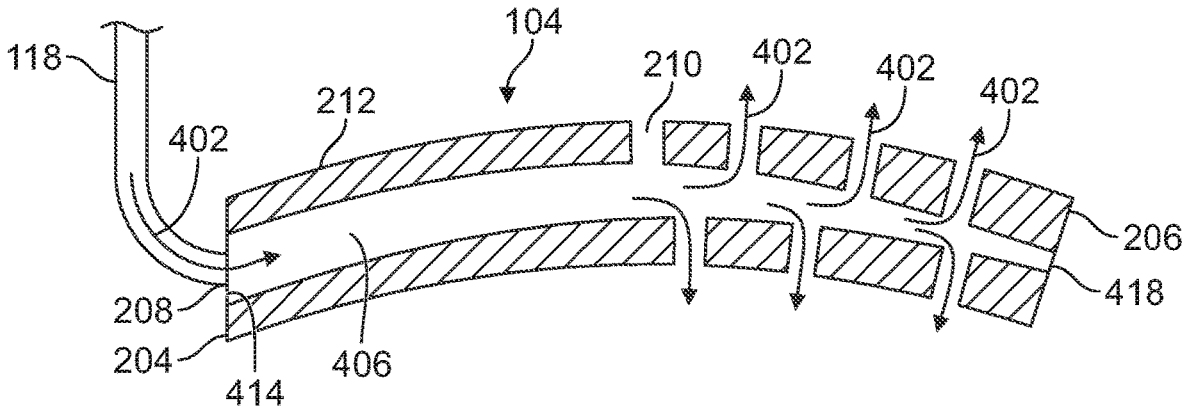
FIG. 4 illustrates a cross-sectional view of the spray nozzle segment device of FIG. 3 in accordance with one embodiment.

FIG. 3 illustrates a schematic view of the spray nozzle segment device 104 in accordance with one embodiment. FIG. 4 illustrates a cross-sectional view of the spray nozzle segment device 104 in accordance with one embodiment. FIGS. 3 and 4 will be described in detail together.

The housing 202 of the spray nozzle segment device 104 has a substantially circular cross-sectional shape and is elongated between a first end 204 and a second end 206. In the illustrated embodiment, the housing 202 is substantially tubular in shape and includes a curve or arc between the first and second ends 204, 206. For example, the housing 202 of each device 104 is shaped such that the device 104 extends partially circumferentially about or around a part of the central axis 110 (of FIG. 1). Additionally, the housing 202 is shaped such that the coupled devices 104 form or create a circular rail system 140 that is substantially concentric with the inner and outer surfaces 114, 116 of the component 106 about or around the central axis 110. Optionally, the housing 202 may have any alternative shape and/or size, may not include a curve or arc between the first and second ends 204, 206, or any combination therein.

The housing 202 includes an inlet 208 that receives the tube 118 that extends into the component 106. The inlet 208 fluidly couples the tube 118 with a conduit 406 of the housing 202. The slurry mixture 402 is received into the device 104 through the inlet 208. In the illustrated embodiment, the inlet 208 is disposed at the first end 204 of the housing 202. Additionally or alternatively, the inlet 208 may be disposed at any location and/or surface of the housing 202. For example, the inlet 208 may be disposed at an outer surface 212 of the housing 202 at any location between the first and second end 204, 206.

In one or more embodiments, the housing 202 may have two or more inlets. For example, a first inlet may be fluidly coupled with a first tube and receive a first fluid (e.g., a gas such as air), and the second inlet may be fluidly coupled with a second tube and receive the slurry of fluid and ceramic particles. For example, the slurry mixture 402 may be formed inside the housing 202.

The conduit 406 of the housing 202 is a hollow chamber that extends through the housing 202 from a conduit inlet 414 to a conduit outlet 418. The conduit 406 has a conduit diameter that narrows between the conduit inlet 414 to the conduit outlet 418 such that the conduit 406 has a diameter at the conduit outlet 418 that is less than a diameter at the conduit inlet 414. The narrowing diameter of the conduit 406 causes the fluid therein to increase in speed through the conduit 406.

In one or more embodiments, the spray nozzle segment device 104 is fluidly and operably coupled with a second spray nozzle segment device 104. For example, the second end 206 of the device 104 illustrated in FIGS. 3 and 4 may be operably coupled with a first end of a second device (not shown). Additionally, the conduit outlet 418 of the device 104 illustrated in FIGS. 3 and 4 may be fluidly coupled with a conduit inlet of a second device (not shown) such that the slurry mixture 402 may flow from the device 104 to the second device 104. Optionally, the two devices 104 may be operably coupled with each other but may not be fluidly coupled with each other. For example, the first device may not include a conduit outlet 418 and the second device may include a conduit inlet that receives the slurry mixture through a second tube 118.

The delivery nozzles 210 of the device 104 are fluidly coupled with the conduit 406 at a location between the conduit inlet 414 and the conduit outlet 418. The delivery nozzles 210 direct the slurry mixture 402 towards the surfaces of the component 106 being coated. For example, the conduit 406 and the housing 202 are shaped to control a flow rate of the slurry mixture 402 between the conduit inlet 414 and the delivery nozzles 210 and/or the outlet 418. In the illustrated embodiment, the delivery nozzles 210 are disposed at a location downstream from the inlet 208 at a location between the first and second ends 204, 206. Additionally, the delivery nozzles 210 are spaced apart from each other in substantially uniform distances and directions. For example, the delivery nozzles 210 are disposed around the outer surface 212 of the housing 202 in order to direct the slurry mixture 402 out of the housing 202 and onto the component 106 in different directions. Optionally, the delivery nozzles 210 may be disposed closer to or further apart from each other, have a random and/or patterned configuration, or any combination therein.

The spray nozzle segment device 104 is held in a position inside the component 106 by the support fixture 132. In the illustrated embodiment, the second end 136 of the support fixture 132 is operably coupled with the device 104 at a location closer to the second end 206 of the device 104 than the first end 204 of the device 104. Optionally, the support fixture 132 may be operably coupled with the device 104 at any location of the device 104 between the first and second ends 204, 206. Additionally or alternatively, two or more support fixtures 132 may be operably coupled with the device 104 in order to maintain a position of the device 104 inside the component 106 while the delivery nozzles 210 spray the slurry mixture 402 onto the component 106 as the coating on the component 106.

Figure 5:
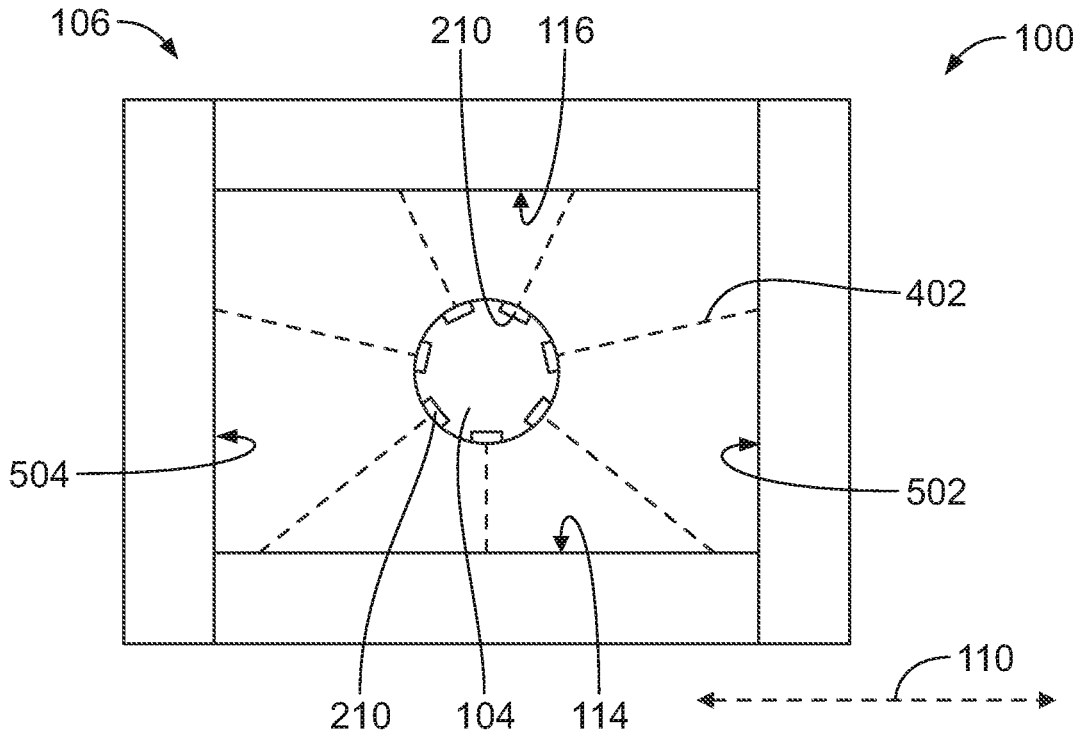
FIG. 5 illustrates a partial cross-sectional view of a coating system in accordance with one embodiment.

FIG. 5 illustrates a partial cross-sectional view of the coating system 100 in accordance with one embodiment. The spray nozzle segment device 104 is disposed inside the component 106 between the inner and outer surfaces 114, 116 of the component in a radial direction (e.g., the radial direction 112 of FIG. 1). Additionally, the spray nozzle segment device 104 is disposed between a first interior surface 502 and a second interior surface 504 in an axial direction. In the illustrated embodiment, the device 104 is disposed substantially centered within the component 106. Optionally, the device 104 may be disposed at any position inside the component 106.

The delivery nozzles 210 of the device 104 direct or spray the slurry mixture 402 onto the inner surface 114, the outer surface 116, the first interior surface 502, and the second interior surface 504. The delivery nozzles 210 spray the slurry mixture 402 to apply a restorative coating as a uniform coating on each surface of the component 106. For example, the device 104 provides 360 degrees of sprayed coating onto the component. Optionally, the device 104 may include delivery nozzles 210 having an alternative configuration such that the delivery nozzles 210 spray the slurry mixture 402 only one surface of the component 106 and not onto the other surfaces of the component 106. For example, the delivery nozzles 210 may apply the coating as a non-uniform coating on each surface of the component 106.

In one or more embodiments, the delivery nozzles 210 of each device 104 may be configured to deliver the slurry onto one or more surfaces, joints, supports, or the like. For example, a first spray nozzle segment device 104 may be disposed inside the component at a position proximate to a joint between two or more surfaces, and a second spray nozzle segment device 104 may be disposed inside the component at a position proximate a substantially planar surface. The delivery nozzles 210 of the first device may have a first configuration in order to provide a substantially uniform coating onto the two surfaces forming the joint. The delivery nozzles 210 of the second device may have a different, second configuration in order to provide a substantially uniform coating onto the substantially planar surface.

Figure 6:
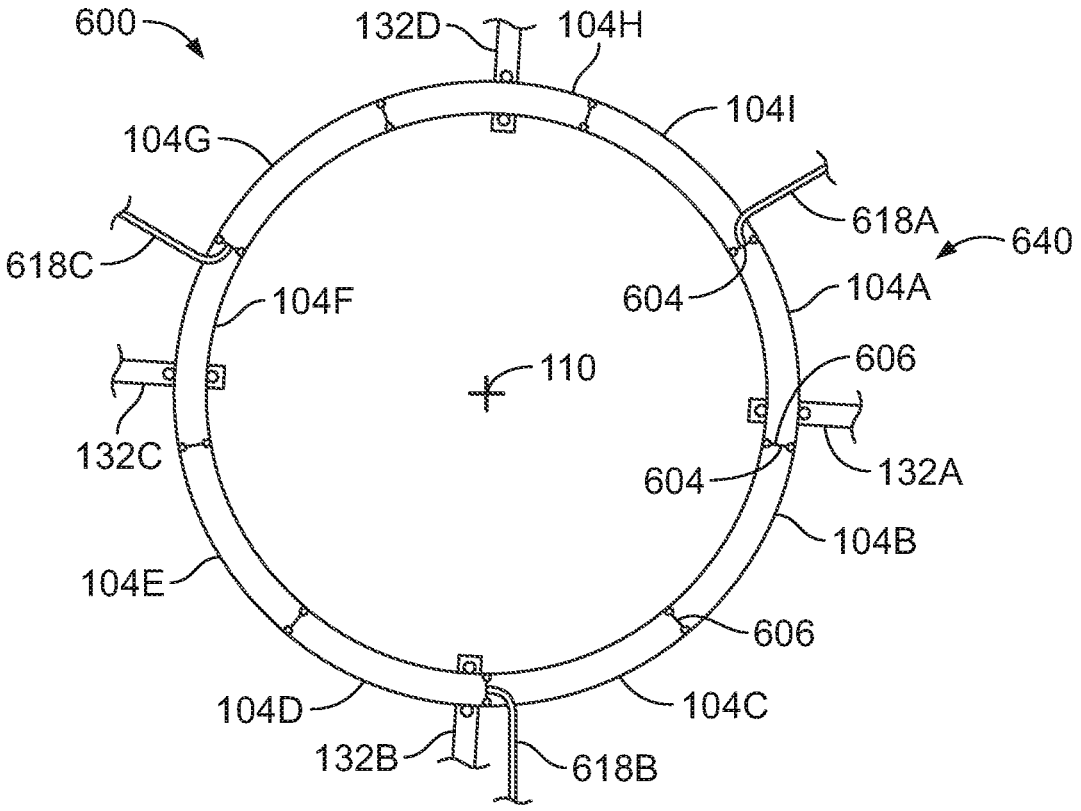
FIG. 6 illustrates a schematic view of a coating system in accordance with one embodiment.

FIG. 6 illustrates a schematic view of a rail system 640 of a coating system 600 in accordance with one embodiment. The rail system 640 includes plural spray nozzle devices 104 that are operably coupled with each other in a circular configuration about or around the central axis 110. In the illustrated embodiment, the rail system 640 includes nine devices 104A-I. Each of the devices 104A-I have substantially a common shape and size. Alternatively, one or more of the devices 104 may have a unique shape or size relative to the other devices 104. The nine devices 104A-I are operably coupled with each other such that a first end 604 of each device is operably coupled with a second end 606 of another device 104 to form or create the circular rail system 640.

The position of each of the devices 104 is maintained with four support fixtures 132A-D that extend into the component and are operably coupled with four different devices 104. In the illustrated embodiment, each support fixture 132 is disposed substantially 90 degrees apart from a different support fixture 132 about or around the central axis 110. Additionally or alternatively, the support fixtures 132 may be disposed at any other random or patterned position about or around the central axis 110 relative to each other support fixture 132.

The coating system 600 includes three tubes 618A-C that deliver the slurry mixture to three different devices 104. For example, a first tube 618A provides the slurry mixture to the device 104A, a second tube 618B provides the slurry mixture to the device 104D, and a third tube 618 provides the slurry mixture to the device 104G. Optionally, the system 600 may include nine tubes to provide the slurry mixture to each of the nine devices, may include a single tube to provide the slurry mixture to one device, or any combination therein.

In the illustrated embodiment, the devices 104A, 104B, and 104C are also fluidly coupled with each other. For example, the slurry mixture that is provided by the first tube 618A to the device 104A flows through the devices 104A, 104B, 104C in order to the delivery nozzles of each of the devices 104A, 104B, 104C to spray the slurry mixture onto the surfaces of the component that are disposed proximate to the devices 104A, 104B, 104C. Additionally, each of the devices 104A, 104B, 104C may be shaped and/or sized in order to control a flow rate of the slurry mixture through each of the devices 104A, 104B, 104C that are fluidly coupled with each other. Similarly, the devices 104D, 104E, and 104F are fluidly coupled with each other. The slurry mixture that is provided by the second tube 618B to the device 104D flows through the devices 104D, 104E, and 104F. The devices 104G, 104H, and 104I are also fluidly coupled with each other such that the slurry mixture provided by the third tube 618C to the device 104G flows through the devices 104G, 104H, and 104I. Additionally or alternatively, the rail system 640 may include any number of devices that may be fluidly coupled with each other and/or operably coupled with each other in any alternative configuration. For example, each of the devices 104A-104I may be fluidly coupled with each other such that each of the devices 104A-104I receives the slurry mixture provided by one or more tubes 118.

Figure 7:
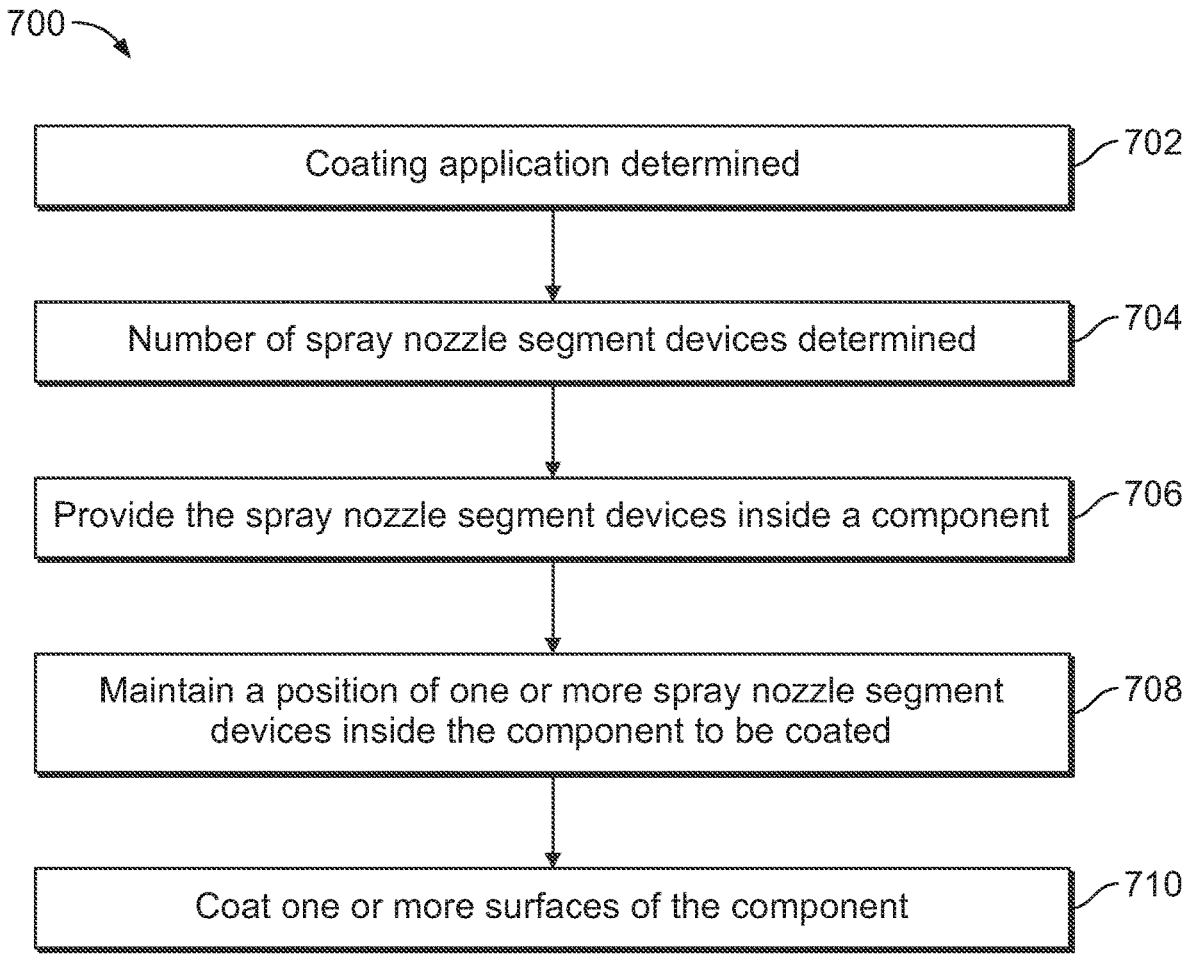
FIG. 7 illustrates a flow chart of a method of coating a surface utilizing a spray nozzle segment device.

FIG. 7 illustrates a flow chart 700 of a method of coating a surface utilizing a spray nozzle segment device. At 702, a coating application where a component needs to be coated is determined. At 704, a determination is made how many surfaces, what areas, how large of an area, or the like, of the component needs to be coated. Based on the determination at 704, one or more spray nozzle segment devices are provided and may be inserted into the component via one or more openings at 706. Two or more of the spray nozzle segment devices may be operably coupled with each other, may be fluidly coupled with each other, or any combination therein.

At 708 a position of the one or more spray nozzle segment devices disposed inside the component is maintained with one or more support fixtures. The support fixtures extend between a first end disposed outside of the component and a second end disposed inside the component. The spray nozzle segment devices are disposed radially outward of a central axis of the component. For example, the devices may be operably coupled with each in order to form a rail system extending circumferentially about or around at least a part of the central axis of the component between an inner surface and an outer surface of the component along a radial direction.

Each of the spray nozzle segment devices also includes plural delivery nozzles. The devices receive a fluid-and-ceramic slurry mixture into the device from a reservoir disposed outside the component via a tube, conduit, coaxial conduit, or the like. In one embodiment, each of the spray nozzle segment devices receives a slurry mixture that includes a slurry of a fluid and ceramic particles combined with a first fluid (e.g., air). The first fluid is used to create droplets from the slurry mixture. Optionally, each device may receive the slurry of the fluid and ceramic particles via one tube or conduit, and the first fluid via a second, different tube or conduit. Optionally, one or more devices receives the fluid-and-ceramic slurry mixture and the slurry mixture flows from one device to each other device fluidly coupled together. Optionally, each of the devices may be fluidly coupled with each other. The devices may receive the slurry of the fluid and ceramic particles via one tube or conduit and the slurry may flow from one device to each other device. One or more of the devices may also receive the first fluid (e.g., the gas) via a second tube or conduit in order to atomize the slurry mixture in order to create droplets from the slurry mixture inside each device. Optionally, each device may receive the slurry mixture, the first fluid, and/or the slurry by an alternative means or method.

At 710, the delivery nozzles spray the slurry mixture onto the component as a coating on the component while the position of the spray nozzle segment device is maintained. For example, while the slurry mixture is sprayed onto the component, the device does not or substantially does not move.

Optionally, the coating system includes a spray controller that is disposed outside the component and is operably coupled with the reservoir. The spray controller may control one or more of an amount of the slurry mixture that is provided to one or more devices, a pressure of the slurry mixture that is provided to one or more devices, a flow rate at which the slurry mixture is provided to one or more devices, a temporal duration at which the slurry mixture is provided to one or more devices, a time at which the slurry mixture is provided to one or more devices, or the like.

In a first example of the method, a turbine engine on a wing of an airplane has a thermal barrier coating that is to be restored. Alcohol is chosen as the fluid to be mixed with the ceramic particles to form the slurry, because alcohol is a fluid that promotes evaporation. After the devices discharge the spray as part of a slurry from the delivery nozzles, droplets that include the fluid are formed. As the droplets traverse through the air, the fluid evaporates substantially reducing the amount of fluid in the droplet before the droplet impacts the surface of the turbine to form the coating.

In a second example of the method when a turbine blade requires a coating, water is the fluid selected to be mixed with the ceramic particles to form the slurry and does not promote evaporation of the fluid. In this example, the temperature of the two-phase droplets is increased compared to the temperature of the two-phase droplets without auxiliary heating of the droplets. Auxiliary heating of the droplets can include, but is not limited to, increasing the temperature of the water flowing to the inlet of the device or increasing the temperature of the water within the device as a result of an additional heat source within the device, or the like. By increasing the temperature of the fluid, in this example water above the ambient temperature, the likelihood of evaporation of the water in the droplets is increased. Thus, the selected temperature of the fluid promotes evaporation. In this embodiment, the amount of water that evaporates from the droplets substantially reduces the amount of water in the droplets upon impact compared to the amount of water discharged from the devices.

In one embodiment of the subject matter described herein, a coating system includes a support fixture sized to be partially inserted into one or more openings of the component and a spray nozzle segment device comprising a housing configured to receive a slurry. The spray nozzle segment device is configured to be disposed radially outward of a central axis of the component and shaped to extend circumferentially about at least part of the central axis of the component. The housing comprises plural delivery nozzles configured to spray the slurry onto a surface of the component. The spray nozzle segment device is configured to be operably coupled with the support fixture such that the support fixture maintains a position of the spray nozzle segment device within the component when the support fixture is partially inserted into the one or more openings of the component.

Optionally, the housing of the spray nozzle segment device is sized to be inserted into the one or more openings of the component.

Optionally, the spray nozzle segment device is fluidly coupled with a reservoir disposed outside the component with one or more valves.

Optionally, the coating system also includes plural spray nozzle segment devices. Each of the spray nozzle segment devices are configured to be operably coupled with each other spray nozzle segment device in order to form a rail system extending circumferentially about at least part of the central axis of the component.

Optionally, each of the plural spray nozzle segment devices are fluidly coupled with each other nozzle segment device. Each of the plural spray nozzle segment devices are configured to receive the slurry.

Optionally, each of the plural spray nozzle segment devices are sized in order to control a flow rate of the slurry through each of the plural nozzle segment devices.

Optionally, the coating system also includes plural support fixtures. The plural support fixtures are configured to maintain a position of each of the plural spray nozzle segment devices inside the component.

Optionally, each of the plural spray nozzle segment devices are fluidly coupled with a reservoir disposed outside the component with one or more valves.

Optionally, the coating system also includes a spray controller. The spray controller is configured to control operation of the one or more valves in order to control one or more of an amount of the slurry provided to each of the spray nozzle segment devices, a pressure of the slurry provided to each of the spray nozzle segment devices, a flow rate of the slurry provided to each of the spray nozzle segment devices, a temporal duration at which the slurry is provided to each of the spray nozzle segment devices, or a time at which the slurry is provided to each of the spray nozzle segment devices.

Optionally, the coating system also includes a spray controller configured to control one or more of an amount of the slurry provided to the spray nozzle segment device, a pressure of the slurry provided to the spray nozzle segment device, a flow rate at which the slurry is provided to the spray nozzle segment device, a temporal duration at which the slurry is provided to the spray nozzle segment device, or a time at which the slurry is provided to the spray nozzle segment device.

Optionally, the coating system also includes a spray controller configured to control one or more of an amount of the slurry provided to each of the one or more delivery nozzles, a pressure of the slurry provided to each of the one or more delivery nozzles, a flow rate at which the slurry is provided to each of the one or more delivery nozzles, a temporal duration at which the slurry is provided to each of the one or more delivery nozzles, or a time at which the slurry is provided to each of the one or more delivery nozzles.

Optionally, the slurry includes a first fluid and a slurry of ceramic particles and a second fluid. The slurry is configured to be formed inside the housing.

Optionally, the first fluid is configured to promote evaporation of the second fluid as droplets of the slurry traverse from the housing toward one or more surfaces of the component.

Optionally, the spray nozzle segment device is configured to be inserted into a turbine engine to spray the slurry onto one or more surfaces of the turbine engine without disassembling the turbine engine.

Optionally, the one or more delivery nozzles are configured to spray the slurry onto one or more surfaces of the component to apply the coating as a uniform coating.

Optionally, the spray nozzle segment device is configured to be inserted into a turbine engine to spray the slurry onto one or more surfaces of an interior of the turbine engine.

Optionally, the coating is configured to be deposited on a thermal barrier coating of the component.

Optionally, the housing is shaped to control a flow rate of the slurry between an inlet of the housing and the delivery nozzles of the housing.

In one embodiment of the subject matter described herein, a method includes maintaining a position of a spray nozzle segment device inside a component with a support fixture. The device comprises a housing configured to receive a slurry. The device is configured to be disposed radially outward of a central axis of the component and shaped to extend circumferentially about at least part of the central axis of the component. The housing comprising plural delivery nozzles configured to spray the slurry onto a surface of the component. The support fixture is sized to be partially inserted into one or more openings of the component. The spray nozzle segment device is configured to be operably coupled with the support fixture such that the support fixture maintains a position of the spray nozzle segment device within the component when the support fixture is partially inserted into the one or more openings of the component. The method also includes spraying the mixture onto the component as a coating on the component Optionally, the housing of the spray nozzle segment device is sized to be inserted into the one or more openings of the component.

Optionally, the spray nozzle segment device is fluidly coupled with a reservoir disposed outside the component with one or more valves.

Optionally, the method also includes disposed plural spray nozzle segment devices radially outward of the central axis of the component. Each of the spray nozzle segment devices are configured to be operably coupled with each other spray nozzle segment device in order to form a rail system extending circumferentially about at least part of the central axis of the component.

Optionally, the method also includes fluidly coupling each of the plural spray nozzle segment devices with each other spray nozzle segment device. Each of the plural spray nozzle segment devices are configured to receive the slurry.

Optionally, each of the plural spray nozzle segment devices are sized in order to control a flow rate of the slurry through each of the plural spray nozzle segment devices.

Optionally, each of the plural spray nozzle segment devices are fluidly coupled with a reservoir disposed outside the component with one or more valves.

Optionally, the method also includes controlling operation of the one or more valves in order to control one or more of an amount of the slurry provided to each of the spray nozzle segment devices, a pressure of the slurry provided to each of the spray nozzle segment devices, a flow rate at which the slurry is provided to each of the spray nozzle segment devices, a temporal duration at which the slurry is provided to each of the spray nozzle segment devices, or a time at which the slurry is provided to each of the spray nozzle segment devices.

Optionally, the method also includes controlling one or more of an amount of the slurry provided to the spray nozzle segment device, a pressure of the slurry provided to the spray nozzle segment device, a flow rate at which the slurry is provided to the spray nozzle segment device, a temporal duration at which the slurry is provided to the spray nozzle segment device, or a time at which the slurry is provided to the spray nozzle segment device with a spray controller operably coupled with the spray nozzle segment device.

Optionally, the method also includes controlling one or more of an amount of the slurry provided to each of the one or more delivery nozzles, a pressure of the slurry provided to each of the one or more delivery nozzles, a flow rate at which the slurry is provided to each of the one or more delivery nozzles, a temporal duration at which the slurry is provided to each of the one or more delivery nozzles, or a time at which the slurry is provided to each of the one or more delivery nozzles with a spray controller operably coupled with the spray nozzle segment device.

Optionally, the slurry includes a first fluid and a slurry of ceramic particles and a second fluid. The slurry is configured to be formed inside the housing.

Optionally, the first fluid is configured to promote evaporation of the second fluid as droplets of the slurry traverse from the housing toward one or more surfaces of the component.

Optionally, the method also includes inserting the spray nozzle segment device into a turbine engine to spray the slurry onto one or more surfaces of the turbine engine without disassembling the turbine engine.

Optionally, the one or more delivery nozzles are configured to spray the slurry onto one or more surfaces of the component to apply the coating as a uniform coating.

Optionally, the spray nozzle segment device is configured to be inserted into a turbine engine to spray the slurry onto one or more surfaces of an interior of the turbine engine.

Optionally, the coating is configured to be deposited on a thermal barrier coating of the component.

Optionally, the housing is shaped to control a flow rate at which the slurry flows between an inlet of the housing and the delivery nozzles of the housing.

In one embodiment of the subject matter described herein, a coating system includes a component to be coated. The component includes an inner surface and an outer surface extending circumferentially around at least part of a central axis of the component. One or more support fixtures are sized to be partially inserted into one or more openings of the component. Each support fixture extends between a first end disposed outside of the component and a second end disposed inside the component. The coating system also includes plural spray nozzle segment devices disposed radially outward of the central axis of the component between the inner and outer surfaces of the component. Each of the spray nozzle segment devices comprises a housing configured to receive a slurry. Each housing comprising plural delivery nozzles. The spray nozzle segment devices shaped to extend circumferentially about at least part of the central axis of the component. The spray nozzle segment devices are configured to be operably coupled with the one or more support fixtures inside the component such that the support fixtures maintain a position of each of the spray nozzle segment devices between the inner surface and the outer surface of the component. The delivery nozzles are configured to spray the mixture onto the component as a coating on the component while the position of each of the spray nozzle segment devices is maintained.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A coating system comprising:

a support fixture sized to be partially inserted into one or more openings of a component; and a spray nozzle segment device comprising a housing configured to receive a slurry, the housing comprising an inlet configured to receive the slurry and plural delivery nozzles, wherein the slurry is configured to be concurrently directed onto plural surfaces of the component via the plural delivery nozzles as a coating, the spray nozzle segment device configured to be disposed radially outward of a central axis of the component and shaped to extend circumferentially about at least part of the central axis of the component, wherein the spray nozzle segment device is configured to be operably coupled with the support fixture such that the support fixture maintains a position of the spray nozzle segment device within the component, wherein the spray nozzle segment device is configured to remain stationary in the position while the slurry is configured to be concurrently directed onto the plural surfaces of the component via the plural delivery nozzles.

2. The coating system of claim 1, wherein the housing of the spray nozzle segment device is sized to be inserted into the one or more openings of the component.

3. The coating system of claim 1, wherein the spray nozzle segment device is fluidly coupled with a reservoir disposed outside the component with one or more valves.

4. The coating system of claim 1, further comprising plural spray nozzle segment devices, each of the spray nozzle segment devices configured to be operably coupled with each other spray nozzle segment device in order to form a rail system extending circumferentially about at least part of the central axis of the component.

5. The coating system of claim 4, wherein each of the plural spray nozzle segment devices are fluidly coupled with each other nozzle segment device, wherein each of the plural spray nozzle segment devices are configured to receive the slurry.

6. The coating system of claim 4, further comprising plural support fixtures, wherein the plural support fixtures are configured to maintain a position of each of the plural spray nozzle segment devices inside the component, wherein each of the plural spray nozzle segment devices are configured to remain stationary in the position while the slurry is configured to be concurrently directed onto the plural surfaces of the component via the plural delivery nozzles.

7. The coating system of claim 4, wherein each of the plural spray nozzle segment devices are fluidly coupled with a reservoir disposed outside the component with one or more valves.

8. The coating system of claim 7, further comprising a spray controller, wherein the spray controller is configured to control operation of the one or more valves in order to control an amount of the slurry provided to each of the spray nozzle segment devices.

9. The coating system of claim 1, further comprising a spray controller configured to control one or more of an amount of the slurry provided to the spray nozzle segment device, a pressure of the slurry provided to the spray nozzle segment device, a flow rate at which the slurry is provided to the spray nozzle segment device, a temporal duration at which the slurry is provided to the spray nozzle segment device, or a time at which the slurry is provided to the spray nozzle segment device.

10. The coating system of claim 1, further comprising a spray controller configured to control one or more of an amount of the slurry provided to each of the plural delivery nozzles, a pressure of the slurry provided to each of the plural delivery nozzles, a flow rate at which the slurry is provided to each of the plural delivery nozzles, a temporal duration at which the slurry is provided to each of the plural delivery nozzles, or a time at which the slurry is provided to each of the plural delivery nozzles.

11. The coating system of claim 1, wherein the slurry comprises a first fluid and a slurry of ceramic particles and a second fluid, wherein the slurry is configured to be formed inside the housing.

12. The coating system of claim 11, wherein the first fluid is configured to promote evaporation of the second fluid as droplets of the slurry traverse from the housing toward the plural surfaces of the component via the plural delivery nozzles.

13. The coating system of claim 1, wherein the spray nozzle segment device is configured to be inserted into a turbine engine to spray the slurry onto one or more surfaces of the turbine engine without disassembling the turbine engine.

14. The coating system of claim 1, wherein the housing is shaped to control a flow rate of the slurry between the inlet of the housing and the plural delivery nozzles of the housing.

15. A method comprising:

maintaining a position of a spray nozzle segment device inside a component with a support fixture, the spray nozzle segment device comprising a housing configured to receive a slurry, the housing comprising an inlet configured to receive the slurry and plural delivery nozzles, wherein the slurry is configured to be concurrently directed onto plural surfaces of the component via the plural delivery nozzles, the spray nozzle segment device configured to be disposed radially outward of a central axis of the component and shaped to extend circumferentially about at least part of the central axis of the component, the support fixture sized to be partially inserted into one or more openings of the component, wherein the spray nozzle segment device is configured to be operably coupled with the support fixture such that the support fixture maintains a position of the spray nozzle segment device within the component; and spraying the slurry onto the surface of the component as a coating on the component, wherein the spray nozzle segment device is configured to remain stationary in the position while the slurry is configured to be concurrently directed onto the plural surfaces of the component via the plural delivery nozzles.

16. The method of claim 15, further comprising disposing plural spray nozzle segment devices radially outward of the central axis of the component, each of the spray nozzle segment devices configured to be operably coupled with each other spray nozzle segment device in order to form a rail system extending circumferentially about at least part of the central axis of the component.

17. The method of claim 16, further comprising maintaining a position of each of the plural spray nozzle segment devices inside the component with plural support fixtures, wherein each of the plural spray nozzle segment devices are configured to remain stationary in the position while the slurry is configured to be concurrently directed onto the plural surfaces of the component via the plural delivery nozzles.

18. The method of claim 16, further comprising controlling operation of one or more valves of a reservoir coupled to the plural spray nozzle segment devices in order to control one or more of an amount of the slurry provided to each of the spray nozzle segment devices, a pressure of the slurry provided to each of the spray nozzle segment devices, a flow rate at which the slurry is provided to each of the spray nozzle segment devices, a temporal duration at which the slurry is provided to each of the spray nozzle segment devices, or a time at which the slurry is provided to each of the spray nozzle segment devices.

19. The method of claim 15, further comprising controlling one or more of an amount of the slurry provided to the spray nozzle segment device, a pressure of the slurry provided to the spray nozzle segment device, a flow rate at which the slurry is provided to the spray nozzle segment device, a temporal duration at which the slurry is provided to the spray nozzle segment device, or a time at which the slurry is provided to the spray nozzle segment device with a spray controller operably coupled with the spray nozzle segment device.

20. The method of claim 15, further comprising controlling one or more of an amount of the slurry provided to each of the plural delivery nozzles, a pressure of the slurry provided to each of the plural delivery nozzles, a flow rate at which the slurry is provided to each of the plural delivery nozzles, a temporal duration at which the slurry is provided to each of the plural delivery nozzles, or a time at which the slurry is provided to each of the plural delivery nozzles with a spray controller operably coupled with the spray nozzle segment device.

21. The method of claim 15, further comprising inserting the spray nozzle segment device into a turbine engine to spray the slurry onto plural surfaces of the turbine engine without disassembling the turbine engine.

* * * * *